US006896719B2

(12) United States Patent
Coates et al.

(10) Patent No.: US 6,896,719 B2
(45) Date of Patent: May 24, 2005

(54) DIRT COLLECTING SYSTEM FOR A FLOOR CARE APPLIANCE

(75) Inventors: Donald A. Coates, Canton, OH (US); Steven W. Blate, North Canton, OH (US)

(73) Assignee: The Hoover Company, North Canton, OH (US)

( * ) Notice: Subject to any disclaimer, the term of this patent is extended or adjusted under 35 U.S.C. 154(b) by 404 days.

(21) Appl. No.: 10/256,333

(22) Filed: Sep. 26, 2002

(65) Prior Publication Data

US 2004/0060146 A1 Apr. 1, 2004

(51) Int. Cl.[7] ..... B01D 45/00

(52) U.S. Cl. ..... 95/268; 55/337; 55/426; 55/429; 55/447; 55/DIG. 3; 15/347; 15/353

(58) Field of Search ..... 95/268; 55/337, 55/426, 429, 447, 459.1, DIG. 3; 15/347, 353

(56) References Cited

U.S. PATENT DOCUMENTS

| | | | | |
|---|---|---|---|---|
| 2,529,158 A | | 11/1950 | Hunter | 21/127 |
| 2,542,634 A | * | 2/1951 | Davis et al. | 55/426 |
| 3,562,846 A | | 2/1971 | Creamer | |
| 3,946,458 A | | 3/1976 | Creamer | 15/339 |
| 5,080,697 A | | 1/1992 | Finke | |
| 5,254,147 A | | 10/1993 | Finke | |
| D343,707 S | | 1/1994 | Dyson | D32/22 |
| 5,839,159 A | | 11/1998 | Karr | |
| 5,908,493 A | | 6/1999 | Krymsky | |
| D417,533 S | | 12/1999 | Burchard | D32/22 |
| 6,003,196 A | | 12/1999 | Wright | |
| 6,026,540 A | | 2/2000 | Wright et al. | |
| D426,357 S | | 6/2000 | Tsuruha | D32/22 |
| 6,070,291 A | | 6/2000 | Bair et al. | |

FOREIGN PATENT DOCUMENTS

GB 2369290 A 5/2002

* cited by examiner

*Primary Examiner*—Robert A. Hopkins
(74) *Attorney, Agent, or Firm*—A. Burgess Lowe; Michael J. Corrigan

(57) ABSTRACT

A dirt collecting system for a vacuum cleaner includes a dirt cup formed from a cylindrical sidewall having a disc shaped member separating the dirt cup into an upper portion and a lower portion. The dirty airstream flows past the disc shaped member from the upper portion to the lower portion through a small gap between the outer periphery of the disc shaped member and the sidewall of the dirt cup. The disc shaped member is supported on a centrally located conduit which has apertured walls located both above and below the disc shaped member. The apertured walls allows the airstream to flow into the conduit for further filtering or exiting the dirt cup. The apertured wall located above the disc shaped member improves sustained performance by enabling the airstream to continue to flow through the dirt cup as the lower portion of the dirt cup fills with large dirt particles and the apertured wall located beneath the disc shaped member becomes increasingly restricted. In the various embodiments of the invention, the airstream is directed through the conduit to a fine particle filter located in a compartment at the bottom of the dirt cup, at the top of the dirt cup or into filter sock located at the upper end of the dirt cup. Alternately, the fine particle filter may be located in a separate container located above or below the dirt container.

32 Claims, 10 Drawing Sheets

DIRT COLLECTING SYSTEM FOR A FLOOR CARE APPLIANCE

BACKGROUND OF THE INVENTION

1. Technical Field

Generally, the invention relates to floor care appliances. Particularly, the invention relates to a dirt collecting system for a floor care appliances such as a vacuum cleaner. Even more particularly, the invention relates to a dirt collecting means located in the dirt collecting container to prevent large dirt particles from obstructing all of the dirt collecting container thereby resulting in the floor care appliance maintaining performance longer between the emptying of the dirt collecting container.

2. Background Information

Upright vacuum cleaners are well known in the art. Typically, these upright vacuum cleaners include a vacuum cleaner housing pivotally mounted to a vacuum cleaner foot. The foot is formed with a nozzle opening and may include an agitator mounted therein for loosening dirt and debris from a floor surface. A motor may be mounted to either the foot or the housing for producing suction at the nozzle opening. The suction at the nozzle opening picks up the loosened dirt and debris and produces a stream of dirt-laden air which is ducted to a dirt collecting system located in the vacuum cleaner housing.

In conventional vacuum cleaners, the dirt laden air is ducted into a vacuum cleaner filtration bag supported on or within the vacuum cleaner housing. More recently, however, bagless vacuum cleaners have recently become prevalent in the marketplace. These bagless vacuum cleaners duct the stream of dirt-laden air into a dirt collecting system usually consisting of a dirt and a filtration means which filters the dirt particles from the air stream before exhausting the filtered air stream into the atmosphere. There have been numerous variations of these dirt collecting systems for these bagless vacuum cleaners to separate the dirt particles from the air stream. However, as the dirt collecting containers of these dirt collecting systems fill up, cleaner performance generally drops since the filter element becomes increasingly restricted with debris. There exists a need for a bagless floor care appliance wherein cleaner performance is maintained even as the dirt collecting container begins to fill with debris.

The present invention fulfills this need by providing a dirt collecting system which utilizes a disc shaped member to prevent large dirt particles from re-entering the upper portion of the dirt collecting container wherein at least a portion of a large particle filter is located in the upper portion of the dirt collecting container so that there is a portion of the large particle filter that cannot become restricted as the dirt cup or dirt collecting container fills with debris. The dirt laden airstream is then filtered of fine particles by one or more other filter members.

SUMMARY OF THE INVENTION

Objectives of the invention include providing a new and improved dirt collecting system for use in a bagless vacuum cleaner.

A further objective is to provide a new and improved dirt collecting system which provides improved sustained filtration performance.

A still further objective is to provide a new and improved dirt collecting system for use in a bagless vacuum cleaner which may be easily emptied after use.

A still yet further objective is to provide a new and improved dirt collecting system for use in a bagless vacuum cleaner wherein a disc shaped member and associated elements are used to prevent large dirt particles from re-entering the upper portion of the dirt cup.

These and other objectives will be readily apparent from the following description taken in conjunction with the accompanying drawings.

In carrying out the invention in one form thereof, these objectives and advantages are obtained by providing a dirt collecting system interposed in the dirt laden airstream comprised of a dirt cup including a disc shaped member separating the dirt cup or dirt container into an upper portion and a lower portion. The dirt laden airstream enters the dirt cup through a curved inlet duct and caused to swirl downward by gravity, suction through a central screen, and a frusto-conical shaped member. The airstream descends in the dirt cup and flows past the disc shaped member from the upper portion to the lower portion through a small gap between the outer periphery of the disc shaped member and the inner sidewall of the dirt cup or through a larger opening on one position on the circumference of the disc shaped member. The disc shaped member is supported by being mounted on a conduit located centrally within the dirt cup. The conduit provides a path for the airstream to exit the interior of the dirt cup. The wall of the conduit is partially formed with a plurality of apertures above and below the disc shaped member for allowing the airstream to exit the interior volume of the dirt cup and enter the conduit. As the airstream enters the hollow interior of the conduit through this "apertured wall", the airstream is filtered of large dirt particles which are deposited in the lower portion of the dirt cup. The dirt laden airstream may be forced into the dirt cup as is common with "direct" air systems or it may be drawn into the dirt cup by a suction motor as is common with "indirect" air systems.

The apertured wall beneath the disc shaped member extends from the disc shaped member to the lower end of the conduit to a short distance above the bottom of the dirt cup. The apertured wall above the disc shaped member extends a short distance above the disc shaped member. The apertured wall beneath the disc shaped member aids in drawing the swirling airstream down into the lower portion of the dirt cup past the disc shaped member. Once the dirt laden airstream flows past the disc shaped member, large dirt particles are generally trapped in the lower portion of the dirt cup since the large dirt particles are no longer part of a directed airstream which would be necessary to guide the large dirt particles through the narrow gap between the outer periphery of the disc shaped member and the inner sidewall of the dirt cup or a larger opening or notch at one angle on the circumference of the disc shaped member distant from the inlet opening of the dirt cup. As dirt particles accumulate in the lower portion of the dirt cup, the apertured wall beneath the disc shaped member becomes increasingly restricted. Normally, this would reduce the performance of such a dirt collecting system because the flow of the dirt laden airstream is restricted. However, the dirt laden airstream flowing through the dirt cup is maintained because the airstream can still flow through the apertured wall above the disc shaped member. Because the disc shaped member keeps large dirt particles in the lower portion of the dirt cup, dirt particles are prevented from accumulating around the apertured wall above the disc shaped member. The consumer is instructed to empty the dirt cup when dirt fills the lower chamber.

In the preferred embodiment of the present invention, an annular filter element is located in the dirt cup in a chamber beneath the lower portion of the dirt cup. The airstream filtered now of large dirt particles is directed to the chamber and the annular filter for filtering fine dirt particles. The annular filter is located in the chamber which is created by an annular wall beneath the lower portion of the dirt cup wherein the large dirt particles are collected and the bottom of the dirt cup. After the large particles are deposited in the lower portion of the dirt cup, the airstream is directed from the conduit to the chamber where the annular filter element is located to remove fine dirt particles. After the airstream is filtered of fine dirt particles by the annular filter element, the airstream may be exhausted to the atmosphere or directed to one or more other filters for filtering even finer dirt particles. Alternately, the annular filter may be in fluid communication with a suction source in an indirect air type system.

In a second embodiment of the present invention, an annular filter element is located in the dirt cup in a chamber above the upper portion of the dirt cup wherein the dirt laden airstream initially enters the dirt cup and where the frusto-conical member is located. The airstream filtered now of large dirt particles is directed from the conduit to the chamber and the annular filter for filtering fine dirt particles. The chamber is created by an annular wall above the upper portion of the dirt cup. After the large particles are deposited in the lower portion of the dirt cup and the airstream flows through the apertured wall into the conduit, the airstream is directed to the chamber where the annular filter element is located to remove fine dirt particles. After the airstream is filtered of fine dirt particles by the annular filter element, the airstream may be exhausted to the atmosphere or directed to one or more other filters for filtering even finer dirt particles. Alternately, the annular filter may be in fluid communication with a suction source in an indirect air type system.

In a third embodiment of the present invention, the airstream is further directed to a chamber located above the upper portion of the dirt cup where the dirt laden airstream initially enters the dirt cup and the frusto-conical member is located. A filter sock spans the open end of the chamber which prevents fine dirt particles from exiting the chamber. After the airstream is filtered of fine dirt particles by the filter sock, the airstream may be exhausted to the atmosphere or directed to one or more other filters for filtering even finer dirt particles. Alternately, the filter sock may be in fluid communication with a suction source in an indirect air type system.

In a fourth embodiment of the present invention, an annular filter element is located in a separate container physically located beneath the dirt cup and fluidly connected thereto. The airstream filtered now of large dirt particles is directed to the container and the annular filter located therein for filtering fine dirt particles. After the large particles are deposited in the lower portion of the dirt cup, the airstream is directed from the conduit to the chamber where the annular filter element is located to remove fine dirt particles. After the airstream is filtered of fine dirt particles by the annular filter element, the airstream may be exhausted to the atmosphere or directed to one or more other filters for filtering even finer dirt particles. Alternately, the annular filter may be in fluid communication with a suction source in an indirect air type system.

In a fifth embodiment of the present invention, an annular filter element is located in a separate container physically located above the dirt cup and fluidly connected thereto. The airstream filtered now of large dirt particles is directed to the container and the annular filter located therein for filtering fine dirt particles. After the large particles are deposited in the lower portion of the dirt cup, the airstream is directed from the interior of the conduit to the chamber where the annular filter element is located to remove fine dirt particles. After the airstream is filtered of fine dirt particles by the annular filter element, the airstream may be exhausted to the atmosphere or directed to one or more other filters for filtering even finer dirt particles. Alternately, the annular filter may be in fluid communication with a suction source in an indirect air type system.

DESCRIPTION OF THE PREFERRED EMBODIMENT

Figure 1:
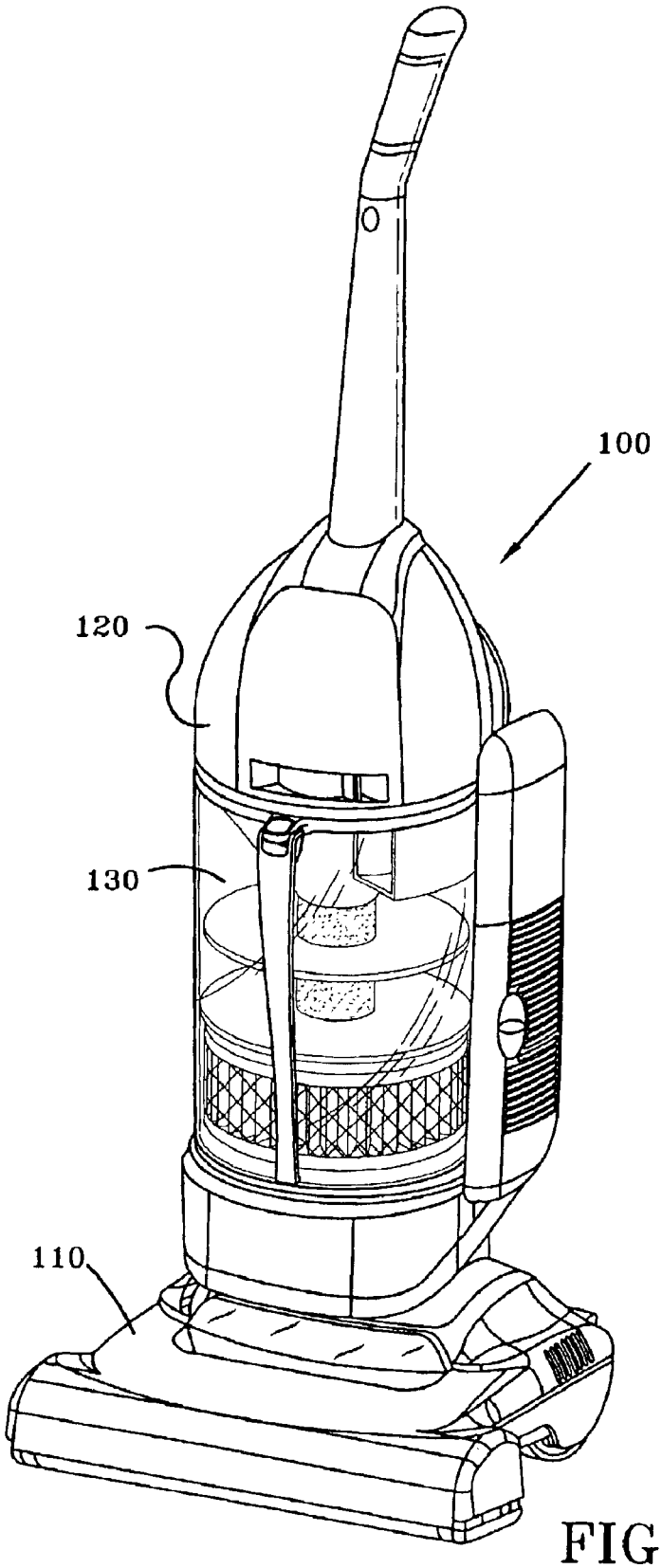
FIG. 1 is a perspective view of a vacuum cleaner with the present dirt collecting system, according to the preferred embodiment of the present invention.

A vacuum cleaner incorporating the preferred embodiment of the present dirt collecting system is shown in FIGS. 1–9 and is indicated generally at 100. Vacuum cleaner 100 includes a vacuum cleaner housing 120 pivotally connected to a suction nozzle or vacuum cleaner foot 110. The foot 110 is typical being formed with a bottom nozzle opening (not shown) which opens towards a floor surface. One or more rotary agitators (not shown) may be positioned within one or more agitator chambers (not shown) which communicates with the bottom nozzle opening. The agitator(s) rotate for loosening dirt from the floor surface before being removed by suction from the suction nozzle 110. A dirt collecting system 130 is positioned in housing 120 for separating and collecting dirt particles from a dirt laden airstream from the suction nozzle 110. The dirt laden airstream is generated by a suction motor 116 (FIG. 2) which may be located in the foot 110 or housing 120.

The dirt collecting system 130 is interposed in the dirt laden airstream and is comprised of a dirt container or dirt cup 131 including a plate or disc shaped member 150 separating the dirt cup 131 into an upper portion 131*b* and a lower portion 131*c*. The dirt laden airstream enters the dirt cup 131 tangentially through an inlet opening 132*a* and caused to swirl partially by a curved inlet duct 132 before entering the upper portion 131*b* of dirt cup 131. The airstream exits the curved duct 132 through the curved duct exit 132*a* and is directed to a swirl generating member 140 which could be frusto-conical shaped which causes it to swirl but also directs the airstream downward along the inner sidewall of the dirt cup 131. The airstream descends in the dirt cup 131 and flows past the disc shaped member 150 from the upper portion 131*b* to the lower portion 131*c* of the dirt cup 131 through a small gap between the outer periphery of the disc shaped member 150 and the inner sidewall of the dirt cup 131. The disc shaped member 150 is supported by being mounted on the outer periphery of a conduit 133 located centrally within the dirt cup 131. The conduit 133 is hollow and provides a path for the airstream to exit the interior 131*a* of the dirt cup 131. The wall of the conduit 133 is partially formed with a plurality of apertures 141 forming an apertured wall 141*a* above the disc shaped member 150 and an apertured wall 141*b* below the disc shaped member 150 for allowing the airstream to exit the respective the upper portion 131*b* and lower portion 131*c* of the dirt cup 131 and enter the hollow interior 133*a* of conduit 133. As the airstream enters the hollow interior 133*a* of the conduit 133 through apertured wall 141*a* in the lower portion 130*a* of dirt cup 131, the airstream is filtered of large dirt particles which are deposited in the lower portion 131*a* of the dirt cup 131. The airstream now filtered of large dirt particles is then directed from the hollow interior 133*a* of conduit 133*b* to one or more other filters for further filtering. In the preferred embodiment of the invention shown, and referring particularly to FIGS. 3–5, the airstream is directed to a cylindrical filter 160 located in a chamber 158 formed in the bottom of dirt cup 131. Chamber 158 is partially formed by a circular wall 155 having an opening 155*a* for the dirt laden airstream to enter from the hollow interior 133*a* of conduit 133.

The dirt laden airstream may be forced into the dirt cup 131 as is common with "direct" air systems or it may be drawn into the dirt cup by a suction motor as is common with "indirect" air systems. In the preferred embodiment shown in FIGS. 1–9, the dirt laden airstream is drawn into the dirt cup 131 by the suction motor 116 located in a chamber 118 beneath dirt cup 131. The suction output of the suction motor 116 is fluidly connected to dirt cup 131 through a suction opening 115 at the base of cavity 125 to the suction inlet opening 135 at the bottom of dirt cup 135. The dirty air inlet opening located in the upper portion 131*b* of dirt cup 131 is fluidly connected to a duct connector 126 located at one end of a suction duct 127. The other end of suction duct 127 is fluidly connected to suction nozzle 110.

Figure 2:
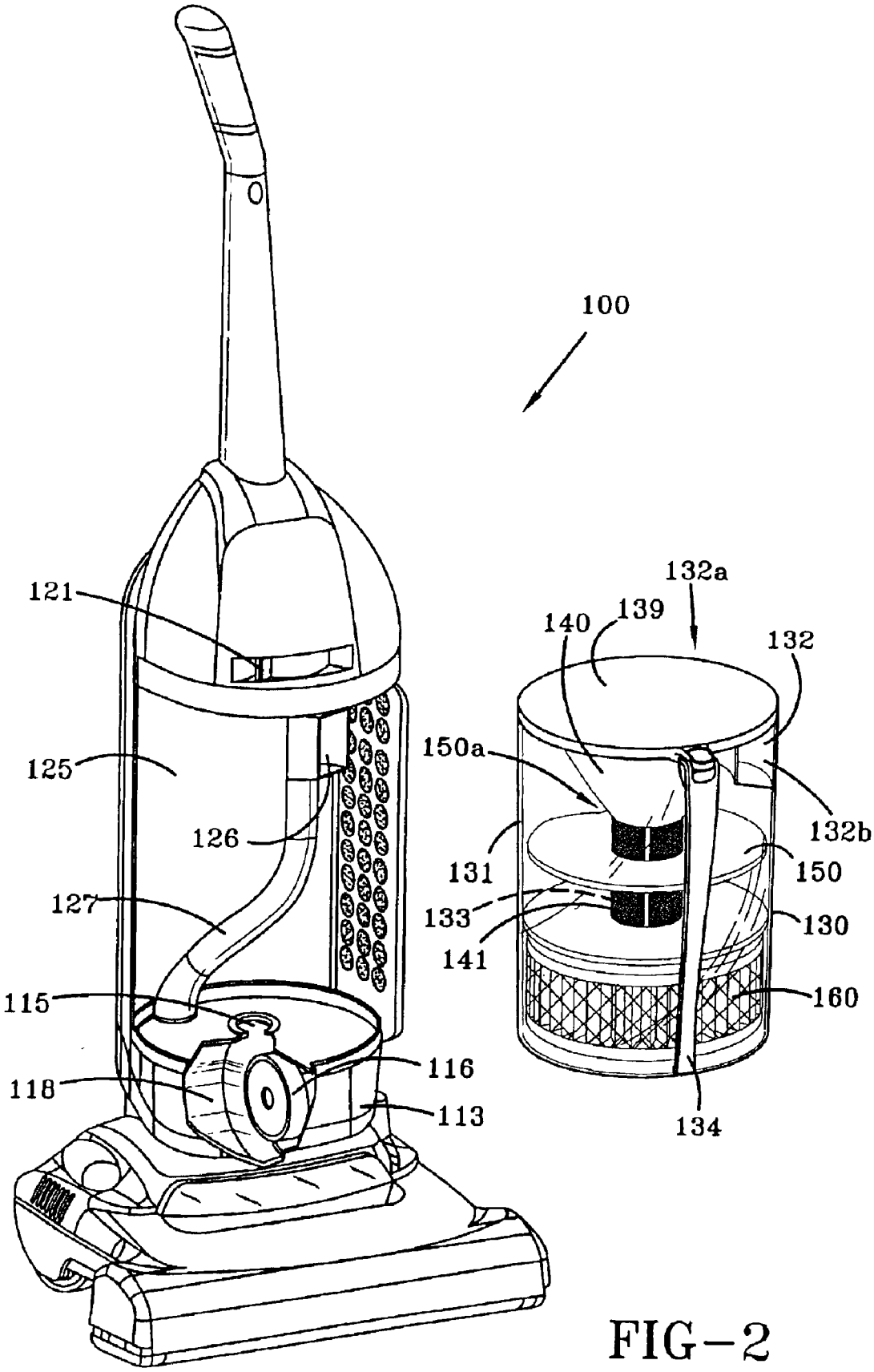
FIG. 2 is a perspective view of a vacuum cleaner with the present dirt collecting system removed from within the vacuum cleaner housing, according to the preferred embodiment of the present invention.
Figure 3:
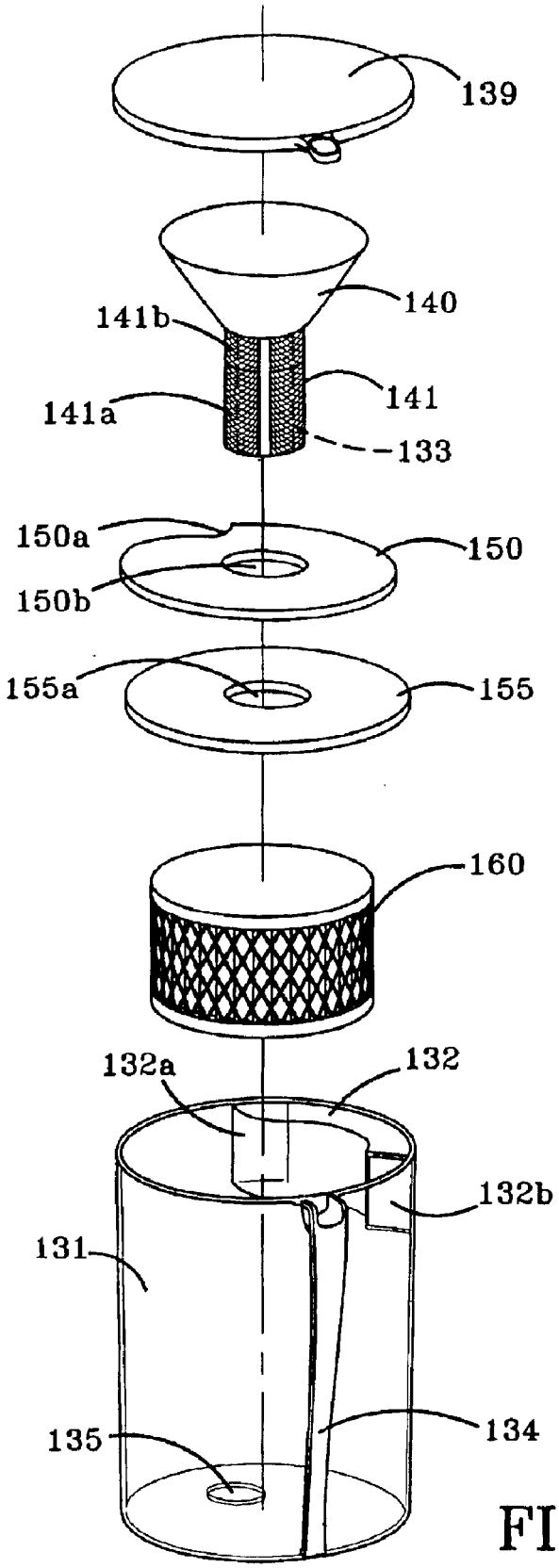
FIG. 3 is an exploded view of the present dirt collecting system vacuum for use with a vacuum such as that shown in FIG. 1, according to the preferred embodiment of the present invention.
Figure 4:
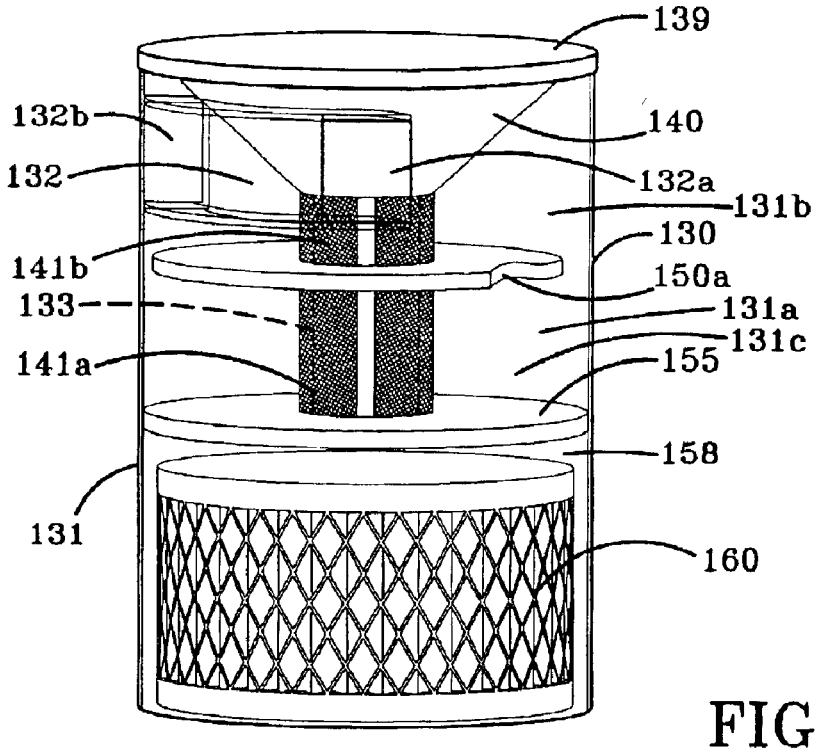
FIG. 4 is a slightly elevated rearview of the present dirt collecting system vacuum, according to the preferred embodiment of the present invention.
Figure 5:
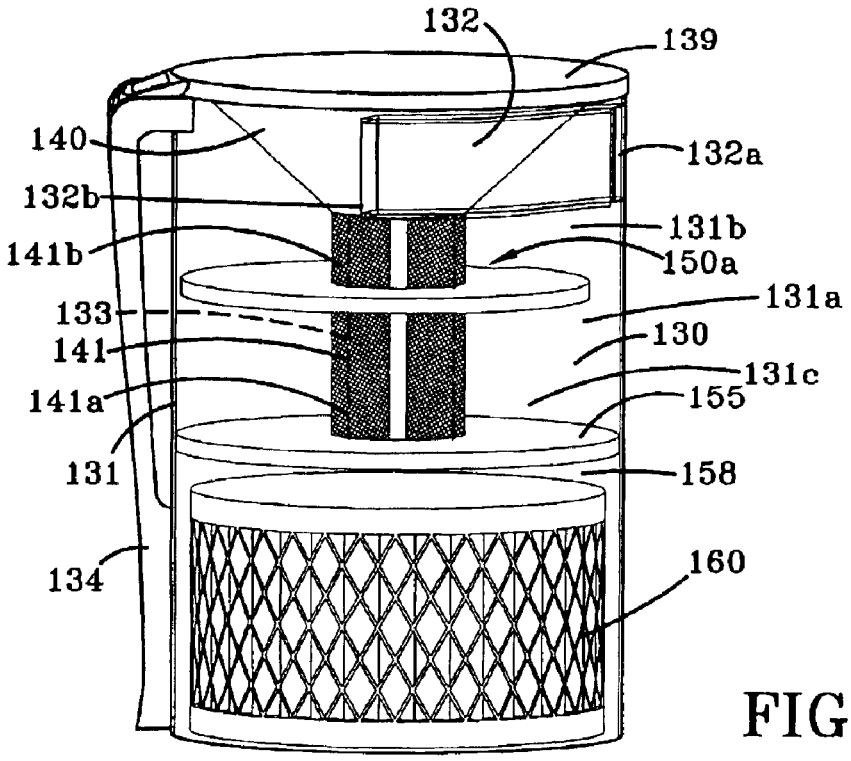
FIG. 5 is a slightly elevated side view of the present dirt collecting system, according to the preferred embodiment of the present invention.
Figure 6:
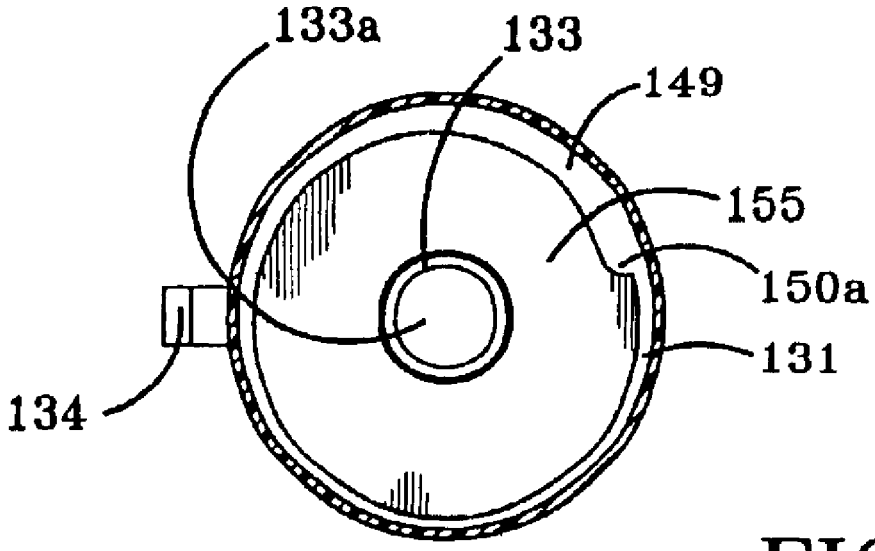
FIG. 6 is a top view of the present dirt collecting system taken along line VI—VI of FIG. 7, according to the preferred embodiment of the present invention.
Figure 7:
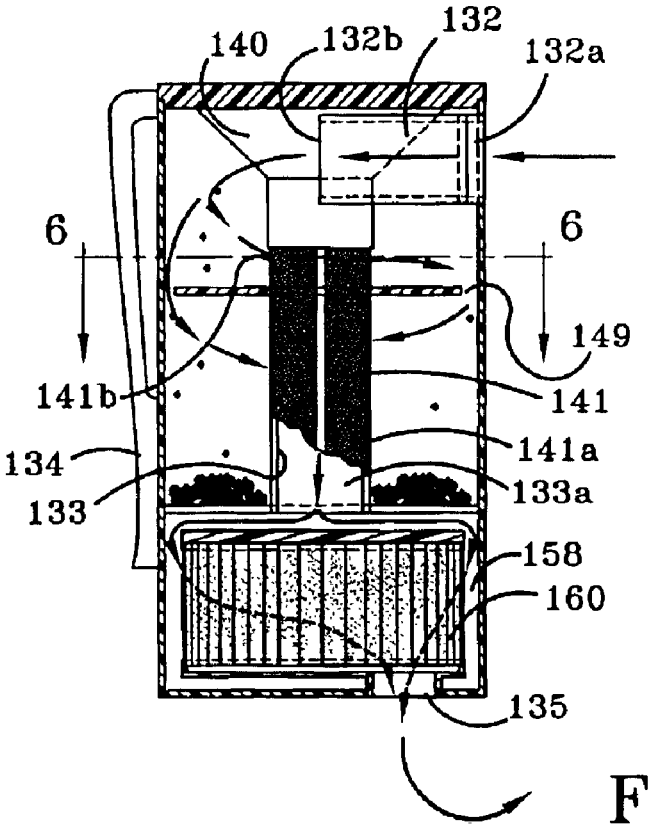
FIG. 7 is a cross-sectional side view of the present dirt collecting system, according to the preferred embodiment of the present invention.

Referring now specifically to FIG. 2, dirt collecting system 130 is normally installed in cavity 125 of housing 120. Dirt collecting system 130 includes a dirt cup 131 which is removed from cavity 125 so that it may be emptied. In the preferred embodiment of the present invention, dirt cup 131 may be fitted with a lid 138 at one end which may be attached thereto with a hinge, a thumb tab on the lid for operating the lid and hinge during emptying, and a handle as described in U.S. patent application Ser. No. 09/123,456 owned by a common assignee and incorporated be reference fully herein.

Referring now more particlularly to FIGS. 3–5 and 8–9, the apertured wall 141*b* above the disc shaped member 150 extends a short distance above the disc shaped member 150. The apertured wall 141*a* beneath the disc shaped member aids in drawing the swirling airstream down into the lower portion 131*a* of the dirt cup 131 past the disc shaped member 150. Once the dirt laden airstream flows past the disc shaped member 150, large dirt particles are generally trapped in the lower portion of the dirt cup 131 since the large dirt particles are no longer part of a directed airstream which would be necessary to guide the large dirt particles through the narrow gap between the outer periphery of the disc shaped member 150 and the inner sidewall of the dirt cup. Disc shaped member 150 has a spiral shaped circumference so that the narrow gap formed between the outer periphery of disc shaped member 150 and the inner sidewall of dirt cup 131 grows increasingly larger in the circumferential direction (illustrated by arrow 900 in FIG. 6) to allow smaller particles to flow past disc shaped member 150 first and then eventually larger particles to flow past disc shaped member 150. A small notch 150*a* is formed in disc shaped member 150 (FIG. 7) just after the point on the circumference of the disc shaped member 150 where the narrow gap between the edge of the disc shaped member 150 and the inner sidewall of the dirt cup 131 is greatest to allow the largest of dirt particles to flow past disc shaped member 150. The majority of dirt particles should flow past disc shaped member 150 prior to circulating to notch 150*a*. The notch 150*a* should be located at a point on the circumference of the disc shaped member 150 distant from inlet opening 132*a* so that the largest of dirt particles flow past disc shaped member 150 before having a chance to reenter the airstream near inlet opening 132*a*.

Figure 8:
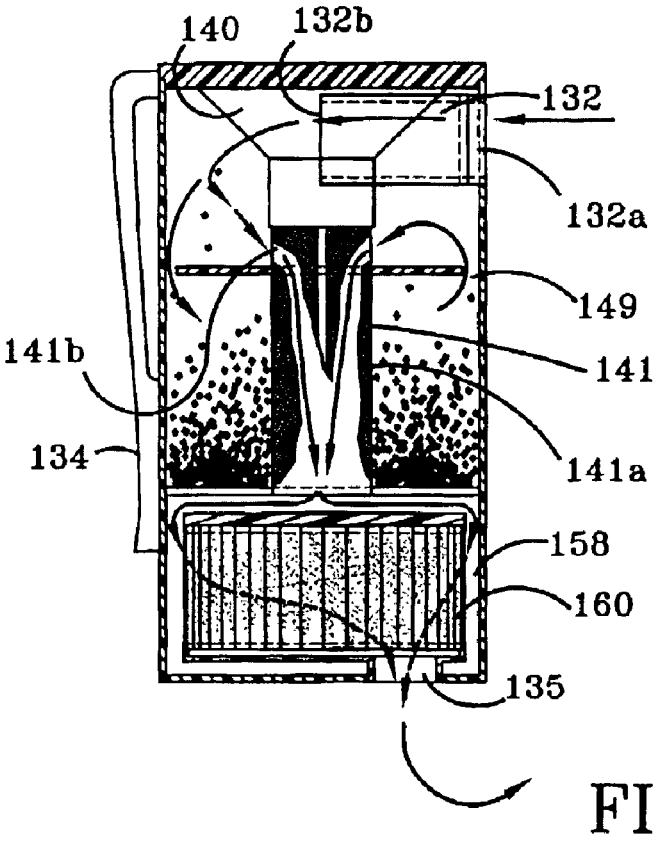
FIG. 8 is a cross-sectional side view of the present dirt collecting system showing a portion of the apertured wall beneath the disc shaped member cutaway and the lower portion of the dirt cup full of debris, according to the preferred embodiment of the present invention.
Figure 9:
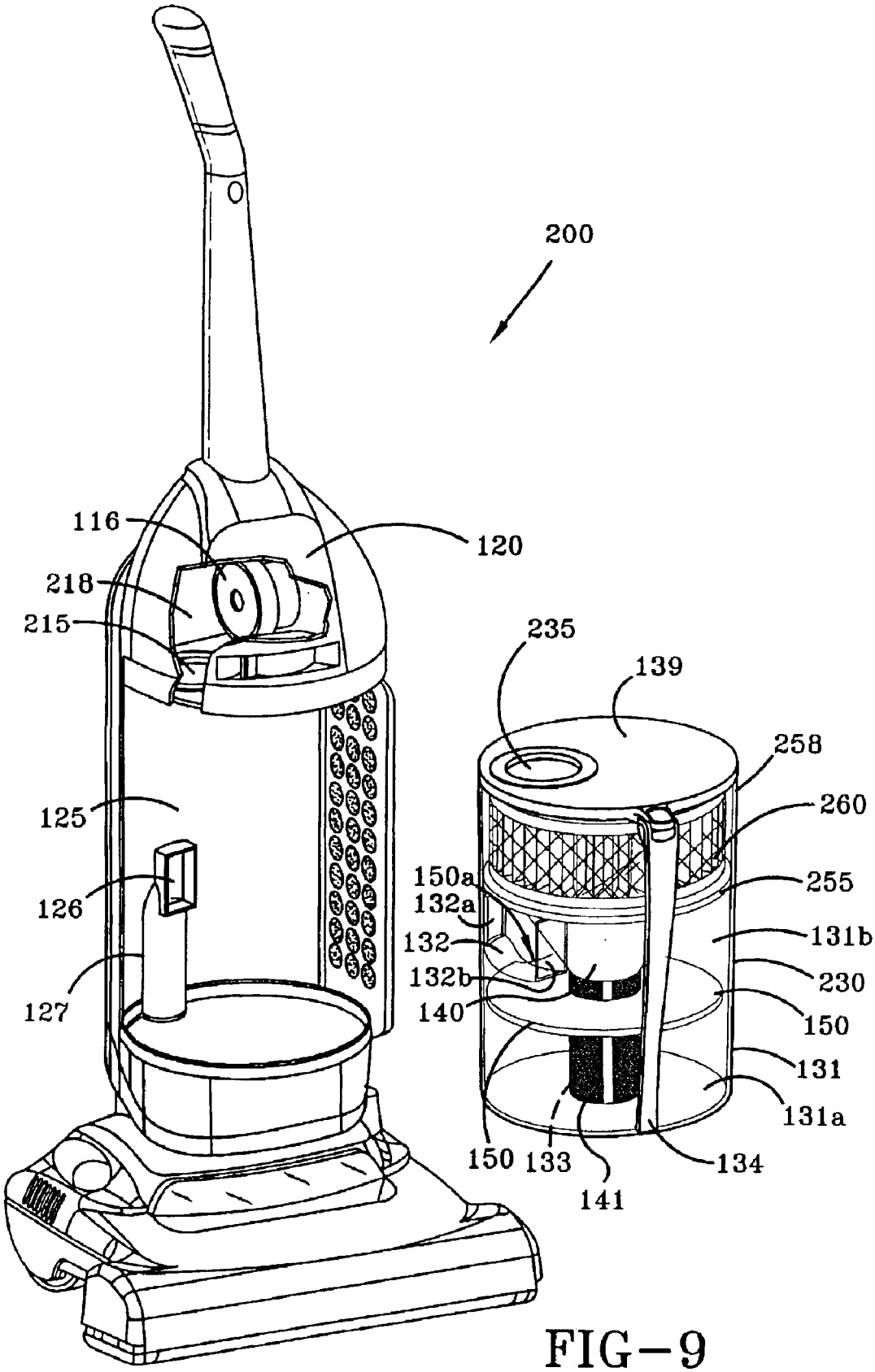
FIG. 9 is a perspective view of a vacuum cleaner with the second embodiment of the dirt collecting system removed from within the vacuum cleaner housing.

As dirt particles accumulate in the lower portion 131*a* of the dirt cup 131, the apertured wall 141*a* beneath the disc shaped member 150 becomes increasingly restricted. Normally, this would reduce the performance of such a dirt collecting system 130 because the flow of the dirt laden airstream is restricted. However, the dirt laden airstream flowing through the dirt cup 131 is maintained because the airstream can still flow through the apertured wall 141*b* located above the disc shaped member 150. Because the disc shaped member 150 keeps large dirt particles in the lower portion 131*a* of the dirt cup 131*a*, dirt particles are prevented from accumulating around the apertured wall 141*b* located above the disc shaped member 150. The flow of the dirt laden airstream through dirt cup 131 is best seen in FIGS. 8 and 9. In FIG. 8, the dirt laden airstream enters the dirt cup and caused to swirl by curved duct 132 and frusto-conical shaped member 140. The airstream descends past disc shaped member 150 to the lower portion 131*a* of dirt cup 131. Large dirt particles are deposited in the lower portion 131*a* of dirt cup 131 and trapped therein by disc shaped member 150. The aistream exits the lower portion 131*a* through apertured wall 141 and is directed through conduit 133 to chamber 158 and filter element 160. The airstream flows around the periphery of filter element 160 and through filter element 160 thereby filtering the airstream of fine dirt particles. The airstream then exits chamber 158 through a suction opening 135. Suction opening 135, as discussed, is fluidly connected to suction motor 116. In an alternate embodiment of the invention, chamber 158 could be fluidly connected through an opening in chamber 158 wherein suction opening 135 is located to the atmosphere or further filtering means. However, as seen in FIG. 9, as the lower portion 131*a* of dirt cup 131 begins to fill with dirt particles, apertured wall 141*a* becomes increasingly restricted and the airstream through the dirt stream is hindered. In order to keep the airstream through the dirt cup 131 flowing as long as possible, an apertured wall 141*b* is located above the disc shaped member 150. Only a portion of the airstream will now flow past disc shaped member 150 which will continue until the lower portion 131*a* is completely filled with dirt particles. At this point dirt cup 131 must be removed from the housing 120 and emptied.

Figure 10:
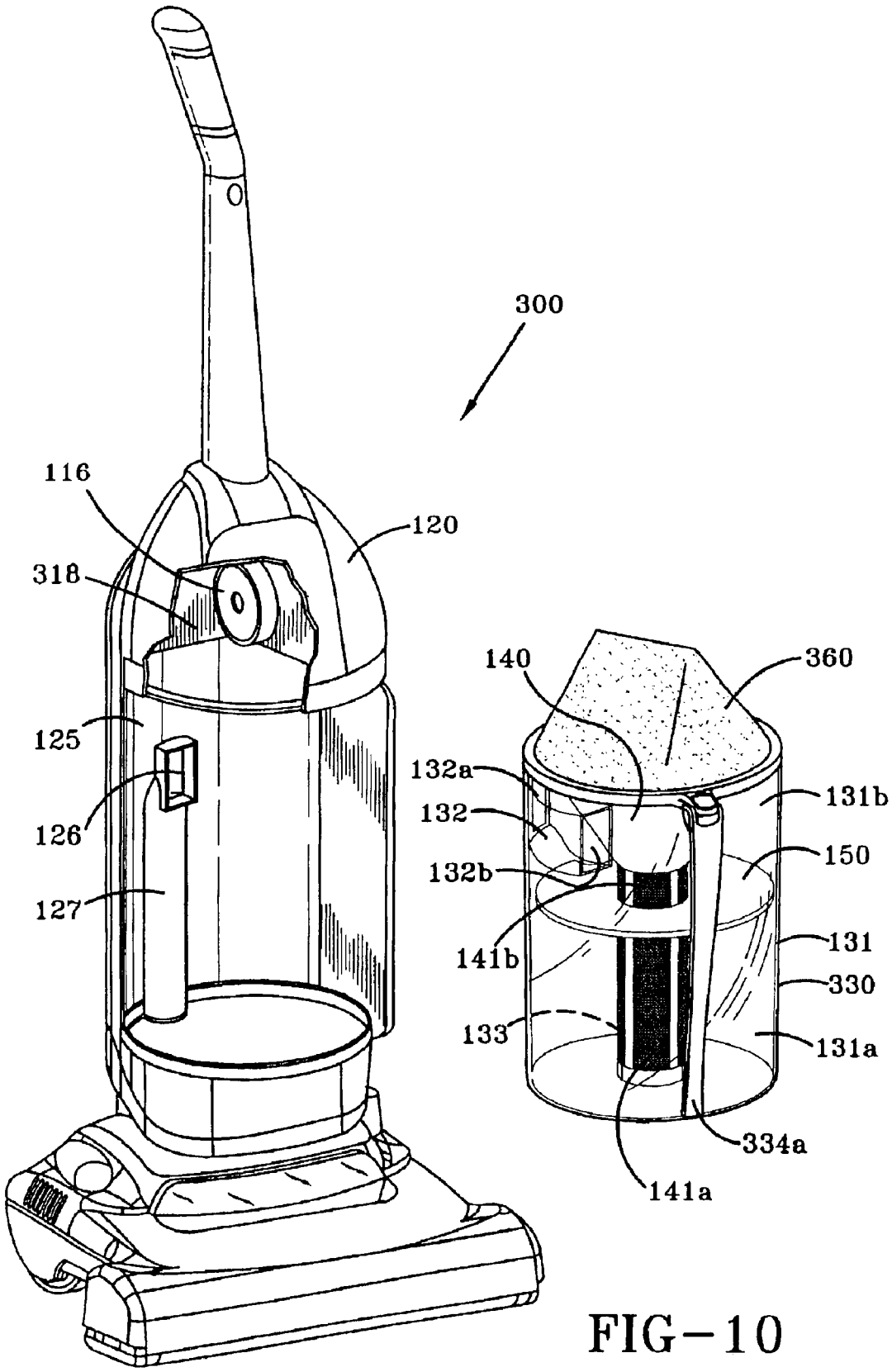
FIG. 10 is a perspective view of a vacuum cleaner with a third embodiment of the dirt collecting system removed from within the vacuum cleaner housing.

In a second embodiment of the present invention, a nearly identical dirt collecting system 230 is provided wherein a filter element 260 is located in the dirt cup 231 in a chamber 258 located in the top of the dirt cup 231. Dirt collecting system 230 functions identical to dirt collecting system 130 except that the airstream filtered of large dirt particles is directed from a conduit 133 to the chamber 258 and the filter element 260 located therein for filtering fine dirt particles. The chamber 258 is created by an annular wall 255 positioned above the upper portion 131*b* of the dirt cup 131. After the airstream is filtered of fine dirt particles by the filter element 260, the airstream may be exhausted to the atmosphere or directed to one or more other filters for filtering even finer dirt particles. In the embodiment shown in FIG. 10, the chamber 258 wherein filter element 260 is located is fluidly connected via an opening 235 to a suction motor 216 located in a chamber 218 located above dirt cup 131. Chamber 218 is located in the upper housing portion 120 of cleaner 100 and there is a aperture 215 allowing the chamber 218 to be fluidly connected to chamber 258 in dirt cup 131.

Figure 11:
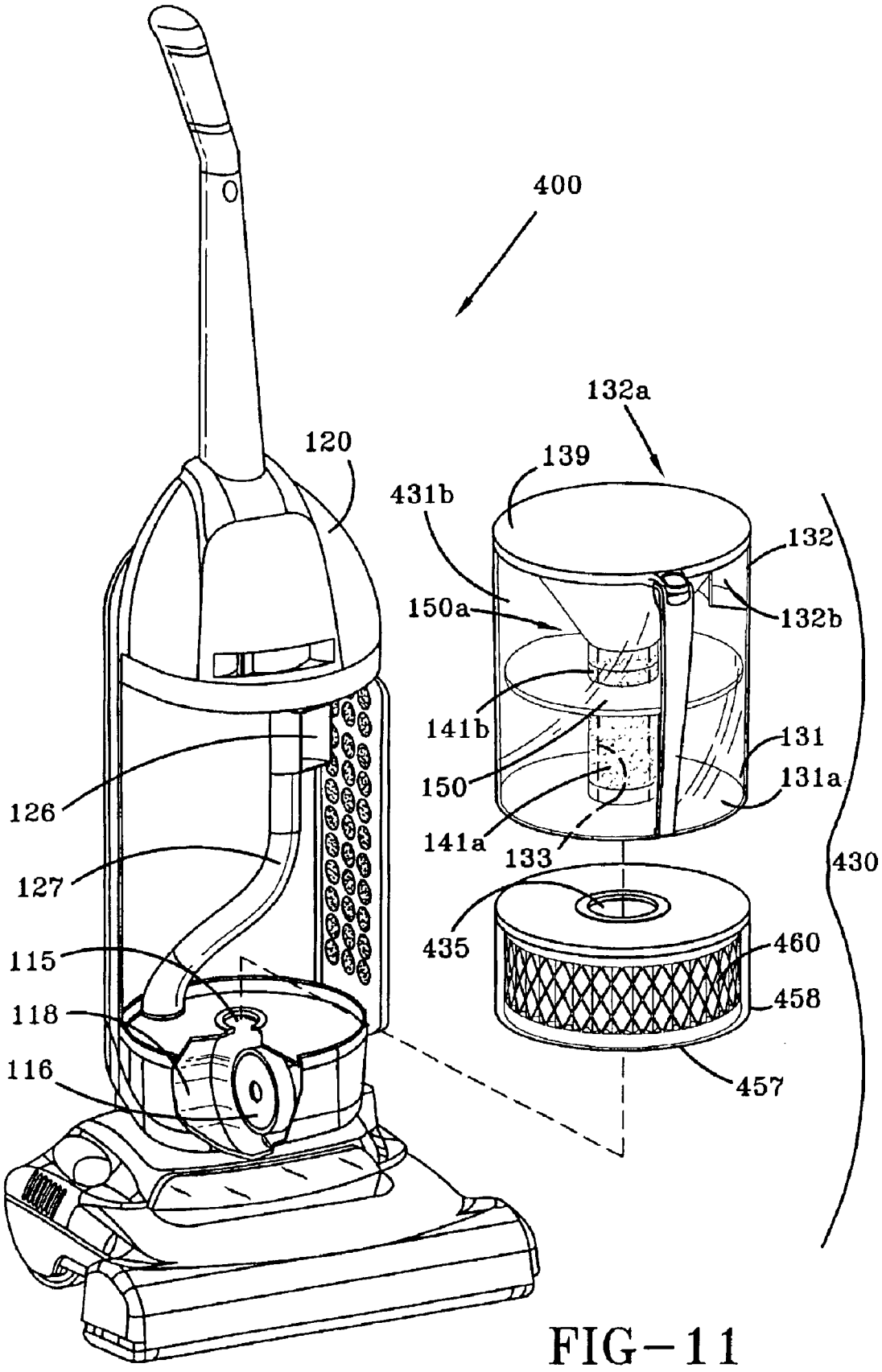
FIG. 11 is a perspective view of a vacuum cleaner with a fourth embodiment of the dirt collecting system removed from within the vacuum cleaner housing.

In a third embodiment of the present invention, and referring now to FIG. 11, a dirt collecting system 330 similar to the dirt collecting system of the second embodiment is provided. However, the filter element 260 located in the top of the dirt cup 131 is replaced with a filter sock 360 that which spans the open end of the upper chamber 131*b* for filtering fine dirt particles. In the embodiment shown in FIG. 11, the filter sock 360 is in fluid communication with a suction motor 216 located in the housing 120 above the dirt cup 131. Filter sock 360 is inserted into a chamber 318 located in the housing 120. Lid 139 on the top of dirt cup 131 is eliminated. Alternately, the airstream after being filtered of fine dirt particles by the filter sock 360 may be directed to one or more other filters for filtering even finer dirt particles. In another embodiment such as in a "direct air" system, the airstream after being filtered of fine dirt particles by the filter sock 360 may be exhausted directly to the atmosphere.

Figure 12:
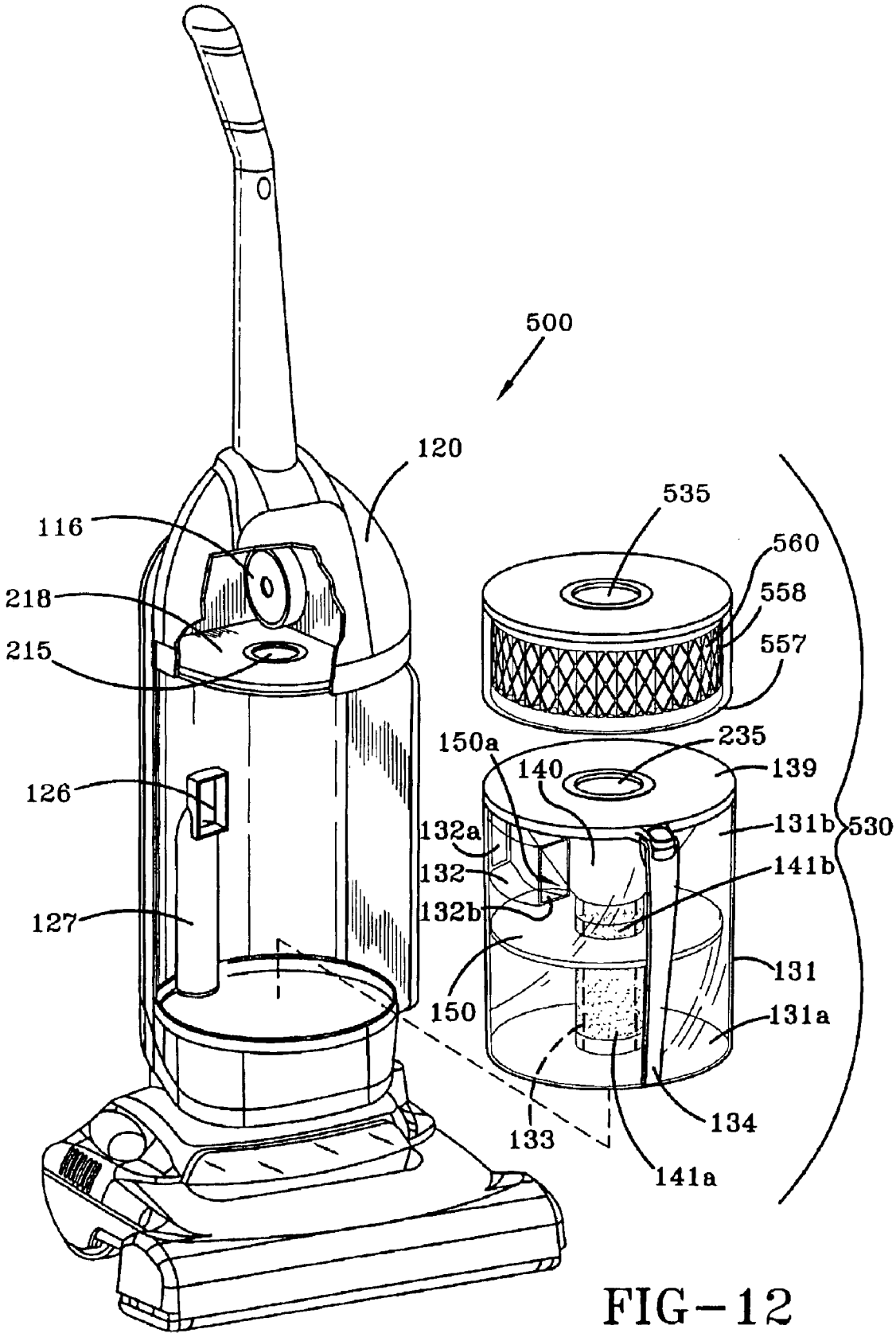
FIG. 12 is a perspective view of a vacuum cleaner with a fifth embodiment of the dirt collecting system removed from within the vacuum cleaner housing.

In a fourth embodiment of the present invention, and referring now to FIG. 12, a dirt collecting system 430 is provided very similar to the first embodiment dirt collecting system except that the filter element 160 (hereinafter labeled numeral 460) located at the bottom of the dirt cup 131 is located in a separate container 457 located beneath dirt cup 131. Container 457 has a chamber 458 where filter element 460 is located. The airstream filtered now of large dirt particles is directed to the container 458 and the filter element 460 located therein for filtering fine dirt particles. After the large particles are deposited in the lower portion 131*a* of the dirt cup 131, the airstream is directed from the conduit 133 to the container 457 where the filter element 460 is located. In the embodiment shown in FIG. 12, the filter element 460 is in fluid communication with a suction motor 116 located in a chamber 118 located in the housing 113 located below the dirt cup 131. Alternately, after the airstream is filtered of fine dirt particles by the filter element 458, the airstream may be directed to one or more other filters for filtering even finer dirt particles. In another embodiment such as in a "direct air" system, the airstream after being filtered of fine dirt particles by the filter element 4548 may be exhausted directly to the atmosphere.

In a fifth embodiment of the present invention, and referring now to FIG. 13, a dirt collecting system 530 is provided very similar to the fourth embodiment dirt collecting system 430 except that the filter element 460 (hereinafter labeled as numeral 560) located in the separate container 457 located beneath the dirt cup 131 is located in a separate container 557 located above the dirt cup 131. The airstream filtered of large dirt particles is directed to the container 557 and to the filter element 558 located therein for filtering fine dirt particles. Filter element 558 is located in a chamber 560 located in container 557. After the large particles are deposited in the lower portion 131*a* of the dirt cup 131, the airstream is directed from the interior 133*a* of the conduit 133 to the container 557 to remove the fine dirt particles. In the embodiment shown in FIG. 13, the filter element 560 is in fluid communication with a suction motor 216 located in container 557 above the dirt cup 131. A chamber 218 located in the upper housing portion 120 of cleaner 100 and there is a aperture 215 allowing the chamber 218 to be fluidly connected to chamber 258 in dirt cup 131. Alternately, after the airstream is filtered of fine dirt particles by the filter element 560, the airstream may be directed to one or more other filters for filtering even finer dirt particles. In another embodiment such as in a "direct air" system, the airstream after being filtered of fine dirt particles by the filter element 558 may be exhausted to the atmosphere.

Accordingly, the improved dirt collecting system for a vacuum cleaner is simplified, provides an effective, inexpensive, and efficient device which achieves all of the enumerated objectives. While there has been shown and described herein several embodiments of the present invention, it should be readily apparent to persons skilled in the art that numerous modifications may be made therein without departing from the true spirit and scope of the invention. Accordingly, it is intended by the appended claims to cover all modifications which come within the spirit and scope of the invention.

What is claimed is:

1. A dirt collecting system for a floor care appliance of the type having a suction source for generating an airstream originating at a suction nozzle, comprising:

a dirt container interposed in the airstream having an inner sidewall;

an inlet in the dirt container in fluid communication with the suction nozzle for allowing the airstream to enter said dirt cup;

a conduit located in said dirt container having one open end;

a member having a peripheral edge extending radially outward from said conduit so that the peripheral edge is a distance from the inner sidewall of the dirt container a distance less than the full distance from the conduit to the inner sidewall of said dirt container;

a first portion of an apertured wall formed in said conduit located in a portion of said dirt container above said member to allow a portion of said airflow from said inlet to flow therethrough while preventing large particles from flowing into said conduit; and a second portion of an apertured wall formed in said conduit located in a portion of said dirt container beneath said member to allow a portion of said airflow from said inlet to flow therethrough while preventing large particles from flowing into said conduit;

wherein a portion of said airstream flows past said member and into said conduit through said second portion of said apertured wall and a portion of said airstream flows into said first portion of said apertured wall.

2. The dirt collecting system of claim 1, wherein said member is spiral shaped and the distance from the peripheral edge of said member to the inner sidewall of the dirt container varies around the circumference of the peripheral edge.

3. The dirt collecting system of claim 1, wherein said member has a notch located in the periphery for allowing larger dirt particles carried by said airstream to pass by said member into a portion of said dirt container located beneath said member.

4. The dirt collecting system of claim 1, wherein said dirt container further includes a compartment separate from said portion of said dirt container above said member and said portion of said dirt container beneath said member.

5. The dirt collecting system of claim 4, further including a filter member located in said compartment for filtering fine dirt particles.

6. The dirt collecting system of claim 4, wherein said open end of said conduit is in fluid communication with said compartment.

7. The dirt collecting system of claim 4, wherein said compartment further includes an exit opening.

8. The dirt collecting system of claim 7, wherein said exit opening is in fluid communication with said suction source.

9. The dirt collecting system of claim 7, wherein said exit opening is in fluid communication with the atmosphere.

10. The dirt collecting system of claim 7, wherein said exit opening is in fluid communication with a filter member located outside of said compartment and said dirt container.

11. The dirt collecting system of claim 1, wherein said one open end of said conduit is in fluid communication with said suction source.

12. The dirt collecting system of claim 1, wherein said one open end of said conduit is in fluid communication with said atmosphere.

13. The dirt collecting system of claim 4, wherein said compartment is located beneath said portion of said dirt cup located beneath said member.

14. The dirt collecting system of claim 4, wherein said compartment is located above said portion of said dirt container above said member.

15. The dirt collecting system of claim 1, wherein said one open end of said conduit is in fluid communication with a filter sock for filtering fine dirt particles.

16. The dirt collecting system of claim 15, wherein said filter sock is in fluid communication with said suction source.

17. The dirt collecting system of claim 15, wherein said filter sock is in fluid communication with the atmosphere.

18. The dirt collecting system of claim 1, further including a conical shaped member located in proximity to the inlet for causing the airstream entering the dirt container to swirl downward.

19. A dirt collecting system for a floor care appliance of the type having a suction source for generating an airstream originating at a suction nozzle, comprising:

a dirt container interposed in the airstream having an inner sidewall;

an inlet in the dirt container in fluid communication with the suction nozzle for allowing the airstream to enter said dirt cup;

a conduit located in said dirt container having one open end;

a member having a peripheral edge extending radially outward from said conduit so that the peripheral edge is a distance from the inner sidewall of the dirt container a distance less than the full distance from the conduit to the inner sidewall of said dirt container;

a first portion of an apertured wall formed in said conduit located in a portion of said dirt container above said member to allow a portion of said airflow from said inlet to flow therethrough while preventing large particles from flowing into said conduit;

a second portion of an apertured wall formed in said conduit located in a portion of said dirt container beneath said member to allow a portion of said airflow from said inlet to flow therethrough while preventing large particles from flowing into said conduit; and a container in fluid communication with said one open end of said conduit; wherein a portion of said airstream flows past said member and into said conduit through said second portion of said apertured wall and a portion of said airstream flows into said first portion of said apertured wall wherein said airstream is directed from said conduit to said container.

20. The dirt collecting system for a floor care appliance of claim 19, wherein said container includes a filter member.

21. The dirt collecting system for a floor care appliance of claim 19, wherein said container is in fluid communication with said suction source.

22. The dirt collecting system for a floor care appliance of claim 19, wherein said container is in fluid communication with the atmosphere.

23. The dirt collecting system for a floor care appliance of claim 19, wherein said container is located beneath said dirt container.

24. The dirt collecting system for a floor care appliance of claim 19, wherein said container is located above said dirt container.

25. The dirt collecting system for a floor care appliance of claim 19, wherein said member is spiral shaped and the distance from the peripheral edge of said spiral shaped member to the inner sidewall of the dirt container varies around the circumference of the peripheral edge.

26. The dirt collecting system for a floor care appliance of claim 19, wherein said member has a notch located in the periphery for allowing larger dirt particles carried by said airstream to pass by said member into a portion of said dirt container located beneath said member.

27. The dirt collecting system for a floor care appliance of claim 19, further including a conical shaped member located in proximity to the inlet for causing the airstream entering the dirt container to swirl downward.

28. A method of collecting particles from a surface, comprising the steps of:

generating a dirt laden airstream originating at a suction nozzle;

inputting the dirt laden airstream into a dirt container in fluid communication with the suction nozzle, the dirt container having an inner sidewall and an inlet for allowing the dirt laden airstream to enter therein;

directing a portion of the dirt laden airstream from the inlet to flow through a gap between the inner sidewall of said dirt container and a member to a portion of the dirt container located beneath said member, the member for preventing large dirt particles from reentering a portion of the dirt container located above said member;

filtering large dirt particles from the dirt laden airstream by further directing said portion of the dirt laden airstream from said inlet through a first apertured wall located beneath said member into a conduit, the large dirt particles being collected in the portion of the dirt container located beneath said member;

directing another portion of the dirt laden airstream from the inlet through a second apertured wall located above a portion of the dirt container located above said member into a conduit for preventing large dirt particles from entering said conduit, and further, allowing a greater portion of the dirt laden airstream to flow into said second apertured wall as the portion of the dirt container located beneath said member fills with dirt particles and restricts said first apertured wall.

29. The method of collecting particles from a surface of claim 28, further including the step of directing the dirt laden airstream into a conical member to cause the airstream to swirl downward.

30. The method of collecting particles from a surface of claim 28, further including the step of directing the dirt laden airstream through one open end of said conduit into a filter member.

31. The method of collecting particles from a surface of claim 28, further including the step of directing the dirt laden airstream through one open end of said conduit to the atmosphere.

32. The method of collecting particles from a surface of claim 28, further including the step of directing the dirt laden airstream through one open end of said tubular member into a filter sock.

* * * * *